US005371962A

United States Patent [19]

Botos

[11] Patent Number: 5,371,962

[45] Date of Patent: Dec. 13, 1994

[54] FOOTBALL DISPLAY BOARD

[76] Inventor: Frank T. Botos, 8421 Corlee Rd., Middletown, Ohio 45042

[21] Appl. No.: 138,730

[22] Filed: Oct. 20, 1993

[51] Int. Cl.[5] ..... G09F 19/00

[52] U.S. Cl. ..... 40/1; 273/94; 434/433; 40/546

[58] Field of Search ..... 273/94, 247, 259; 116/222, 325; 434/430, 433; 40/1, 598, 600, 621, 546, 452

[56] References Cited

U.S. PATENT DOCUMENTS

| | | | |
|---|---|---|---|
| 2,600,940 | 6/1952 | Tullio | 116/222 |
| 2,727,327 | 12/1955 | Colby | 40/546 |
| 2,821,800 | 2/1958 | Hardesty | 40/546 |
| 2,933,316 | 4/1960 | Mancini | 273/94 X |
| 3,222,068 | 12/1965 | Cowels, Jr. | 273/94 X |
| 4,658,523 | 4/1987 | Adell | 40/1 |
| 4,762,323 | 8/1988 | Blagg | 273/94 X |

FOREIGN PATENT DOCUMENTS

| | | | |
|---|---|---|---|
| 2679361 | 1/1993 | France | 40/600 |

*Primary Examiner*—Kenneth J. Dorner
*Assistant Examiner*—Joanne Silbermann
*Attorney, Agent, or Firm*—E. Michael Combs

[57] ABSTRACT

A board member arranged to provide for illustration and representation of football teams is provided, to include a plurality of first and second rows of helmet posts to each receive a helmet member thereon, with each of the first and second posts having an adjacent record post to mount a record indicating flange plate thereon. The flange plate is formed of an erasable material to accommodate illustration of a won/lost record of a team associated with an adjacent helmet on an adjacent helmet post. Plural rows of facing home team and visitor team helmet posts are provided to accommodate positioning of helmets from said helmet posts onto the home team and visitor team helmet posts to indicate pending games of opposing teams.

5 Claims, 4 Drawing Sheets

FIG. 5
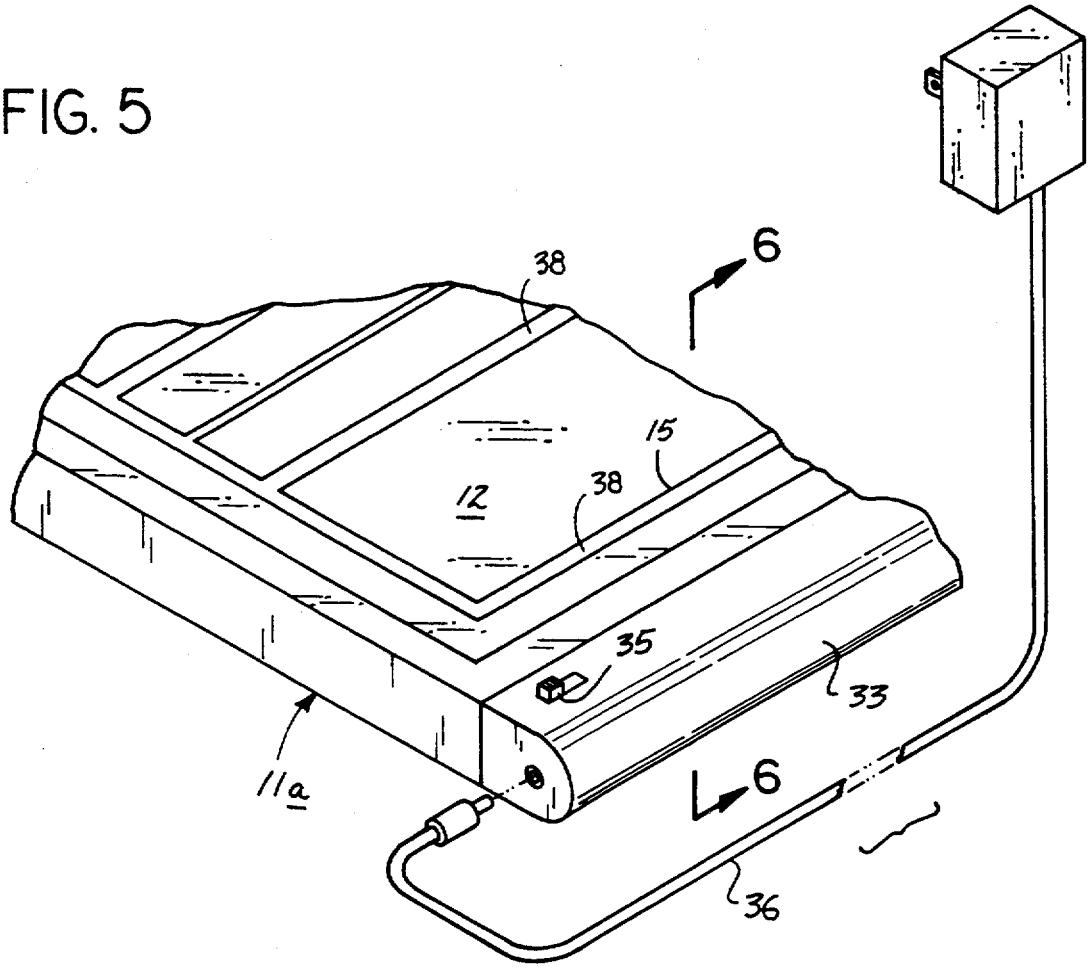
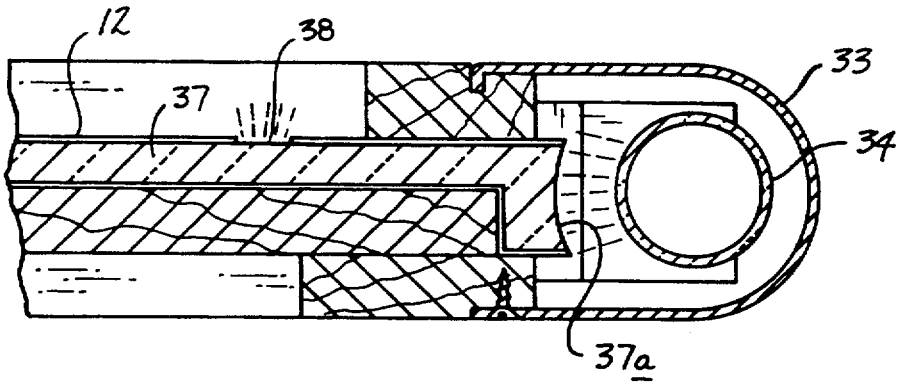
FIG. 6

FOOTBALL DISPLAY BOARD

BACKGROUND OF THE INVENTION

1. Field of the Invention

The field of invention relates to display apparatus, and more particularly pertains to a new and improved football display board wherein the same is arranged to indicate pending teams and pending interplay among the teams.

2. Description of the Prior Art

Display structure per se is known in the prior art, wherein typical display of various items such as pictures, rings, awards, and the like is typically provided in a mounted manner to secure the item for display. The instant invention provides for a display board permitting continuously positioning of the representative football teams to indicate pending interplay among the teams to enhance interest during such interplay and football games and in this respect, the present invention substantially fulfills this need.

SUMMARY OF THE INVENTION

In view of the foregoing disadvantages inherent in the known types of display apparatus now present in the prior art, the present invention provides a football display board wherein the same includes a plurality of helmet posts, with each of the helmet posts having a record indicating post positioned adjacent thereto upon an associated simulated football playing field. As such, the general purpose of the present invention, which will be described subsequently in greater detail, is to provide a new and improved football display board which has all the advantages of the prior art display apparatus and none of the disadvantages.

To attain this, the present invention provides a board member arranged to provide for illustration and representation of football teams, to include a plurality of first and second rows of helmet posts to each receive a helmet member thereon, with each of the first and second posts having an adjacent record post to mount a record indicating flange plate thereon. The flange plate is formed of an erasable material to accommodate illustration of a won/lost record of a team associated with an adjacent helmet on an adjacent helmet post. Plural rows of facing home team and visitor team helmet posts are provided to accommodate positioning of helmets from said helmet posts onto the home team and visitor team helmet posts to indicate pending games of opposing teams.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved football display board which has all the advantages of the prior art display apparatus and none of the disadvantages.

It is another object of the present invention to provide a new and improved football display board which may be easily and efficiently manufactured and marketed.

It is a further object of the present invention to provide a new and improved football display board which is of a durable and reliable construction.

An even further object of the present invention is to provide a new and improved football display board which is susceptible of a low cost of manufacture with regard to both materials and labor, and which accordingly is then susceptible of low prices of sale to the consuming public, thereby making such football display boards economically available to the buying public.

Still yet another object of the present invention is to provide a new and improved football display board which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an isometric illustration of the invention indicating a modified game board structure.

FIG. 6 is an orthographic view, taken along the lines 6—6 of FIG. 5 in the direction indicated by the arrows.

DESCRIPTION OF THE PREFERRED EMBODIMENT

Figure 1:
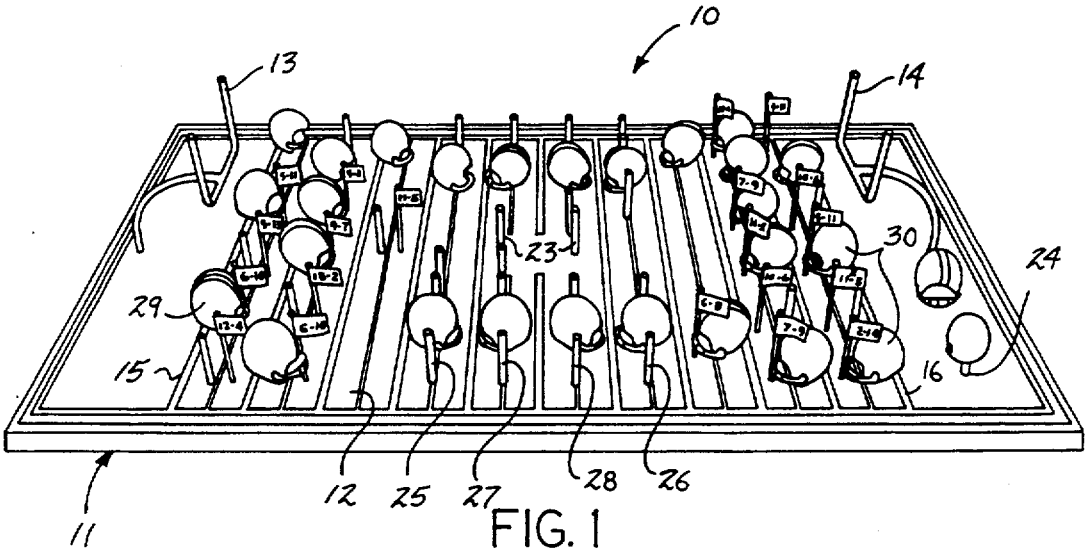
FIG. 1 is an isometric illustration of the invention.

With reference now to the drawings, and in particular to FIGS. 1 to 8 thereof, a new and improved football display board embodying the principles and concepts of the present invention and generally designated by the reference numeral 10 will be described.

Figure 2:
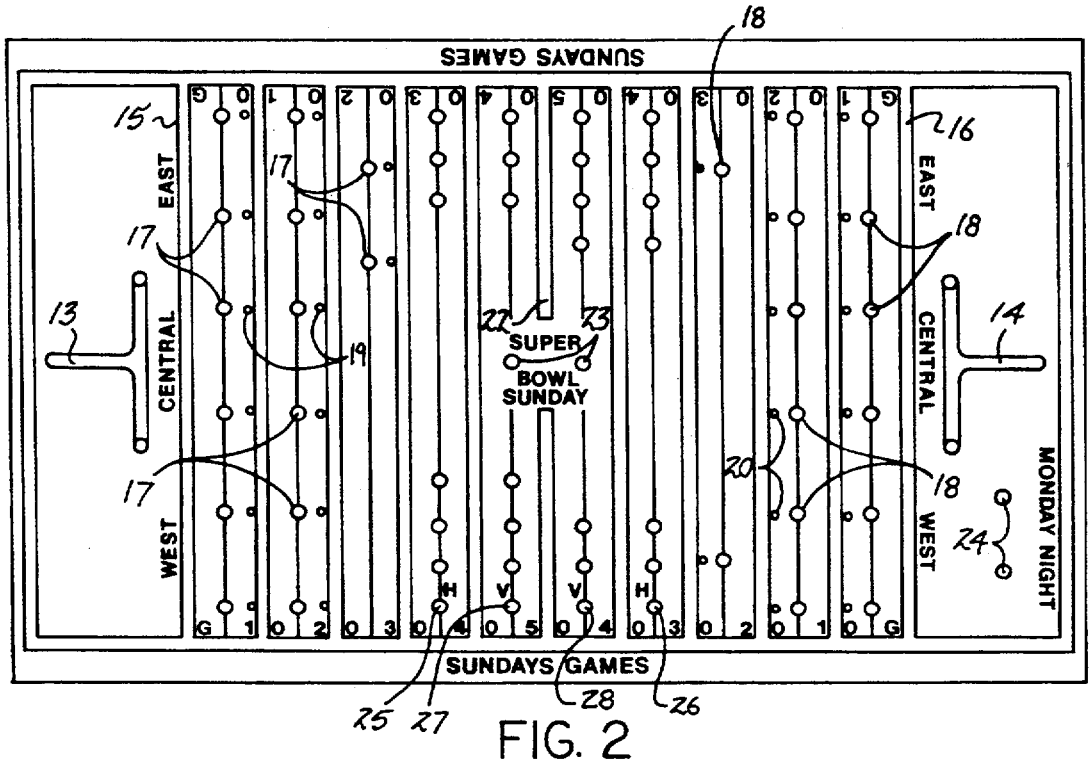
FIG. 2 is an orthographic top view of the board structure.
Figure 3:
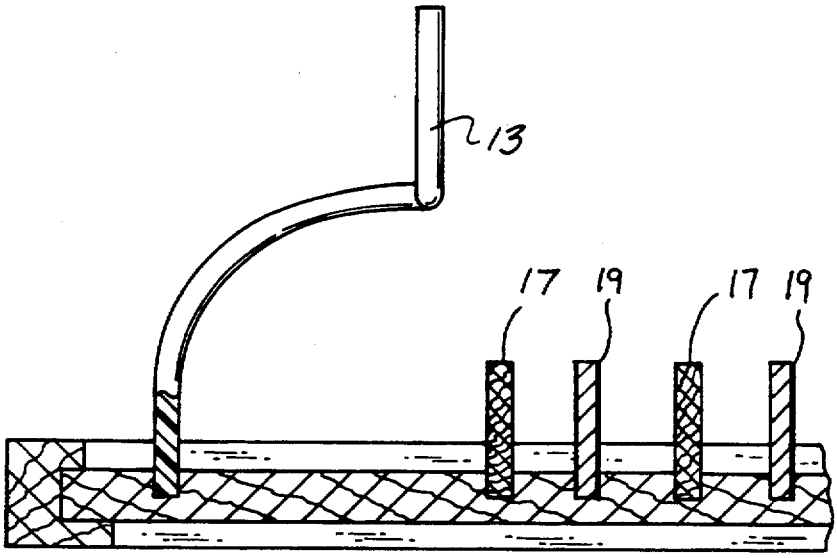
FIG. 3 is an orthographic cross-sectional illustration of an individual helmet post and adjacent record indicating post.
Figure 4:
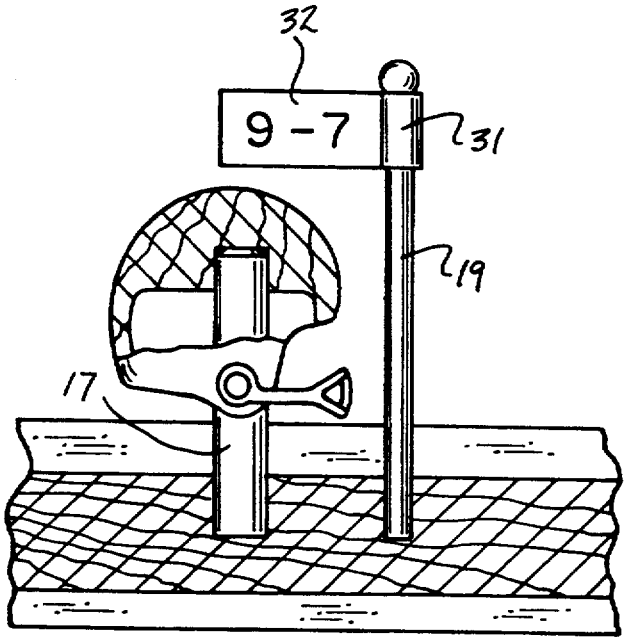
FIG. 4 is an orthographic view, partially in section, of the record indicating post mounting a record display flange thereon.

More specifically, the football display board 10 of the instant invention essentially comprises a rigid display board 11 having an opaque simulated football playing field 12 mounted to a top surface of the display board. First and second goal posts 13 and 14 are positioned within respective first and second end zones of the display boards in adjacency to the playing field. The playing field is designated by opposed, parallel first and second goal lines 15 and 16 and spaced side lines extending parallel relative to one another and orthogonally between the first and second goal lines 15 and 16. A plurality of rows of first helmet posts 17 are oriented such that each of the rows 17 are parallel to the first goal line 15, with a plurality of rows of second helmet posts 18 mounted within the playing field 20 orthogonally thereto, with each of the rows 18 parallel to the second goal line 16. Each of the first helmet posts 17 includes a first record post 19 positioned in adjacency and parallel thereto, such as indicated in the FIGS. 1–4, with each of the second helmet posts 18 having a second record post 20. The record posts 19 and 20 may be formed of a ferromagnetic material to magnetically adhere a record post receiving tube 31 formed of a ferrous metallic material, with each record post receiving tube 31 (see FIG. 4) having an erasable flange 32 extending therefrom. The erasable flange 32 is to provide for numerical designation of a won/loss record of a designated football team designated by an adjacent helmet member. By way of example, the helmets positioned on the first helmet post 17 are designated NFC helmets 29 (National Football Conference (R), while AFC helmets 30 (American Football Conference (R) are mounted upon the second helmet posts 18. Monday night football posts 24 are positioned within the second end zone, as illustrated in FIG. 2 for example, to receive opposing players that evening, while things such as the "Super Bowl" (R) are positioned medially of the mid-field line web 22 and are indicated by the central helmet post 23. First and second rows of home team helmet posts 25 and 26 are positioned in a parallel relationship relative to one another and to opposing sides of the mid-field line web 22, while first and second rows of visitor team helmet posts 27 and 28 are positioned between the mid-field line web 22 and the respective first and second home team helmet posts 25 and 26. In this manner, opposing interplay between opposing teams to include a "home team" and a "visiting team" permits the repositioning of the helmets 29 and 30 onto the home and visitor team helmet posts 25–28 inclusively. In this manner, weekly football games of opposing players may be indicated, while the previous won/loss record of each of the home and visitor teams may be indicated by the record posts 19 and 20 adjacent the helmets, in a manner as noted above. In this manner, visual display provides enhanced entertainment and enjoyment relative to impending games.

The FIGS. 5 and 6 indicate the use of illumination housing 33 mounted to a first end of the display board 11, wherein a lens plate 37 of a translucent material extends coextensively in adjacency to the playing field 12, such that playing field openings 38 are coextensive with the yardage line markers to provide for further enhanced visual indication and demarcation between the various helmets and teams to play in opposing games. An on/off switch 35 selectively directs electrical energy from an electrical power supply transformer 36 to an illumination bulb 34 mounted within the illumination housing 33 in adjacency to a lens plate end wall surface 37*a*. The end wall surface 37*a* is concave to accommodate a greater degree of illumination to be directed through the lens plate 37.

Figure 7:
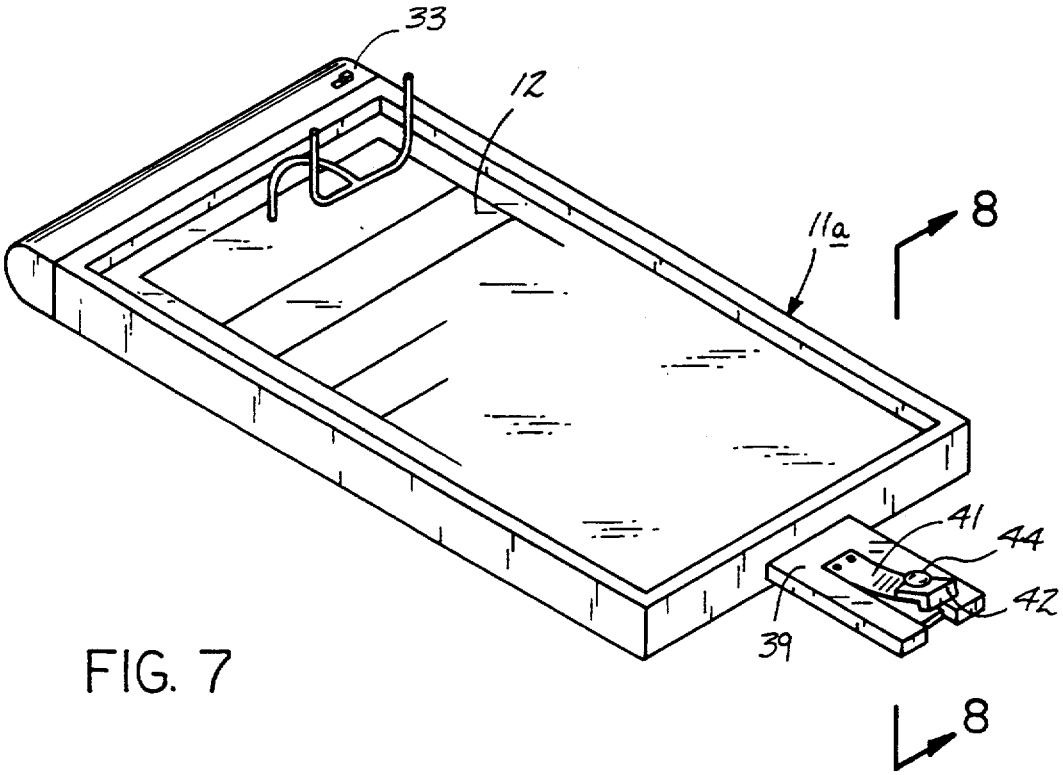
FIG. 7 is an isometric illustration of the game board to further include a football projection accessory.
Figure 8:
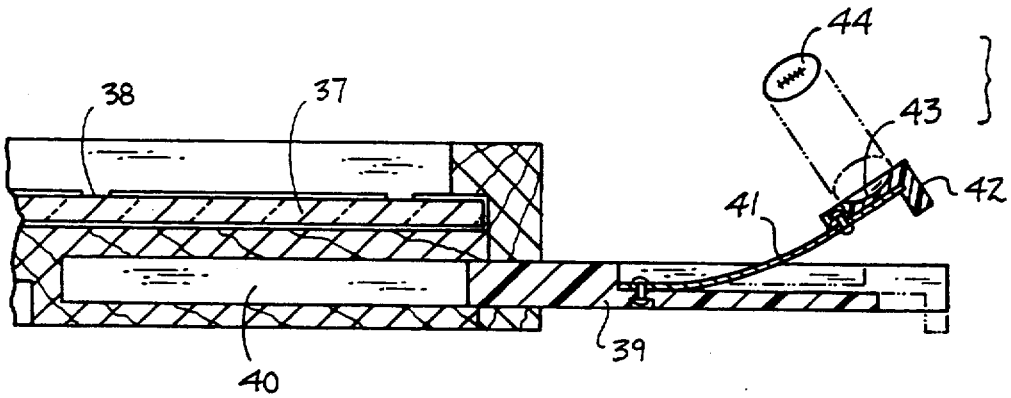
FIG. 8 is an orthographic view, taken along the lines 8—8 of FIG. 7 in the direction indicated by the arrows.

The FIGS. 7 and 8 indicate the second end of the display board 11*a*, wherein a slide plate 39 is reciprocatably mounted through the second end of the display board from a socket 40. A spring plate 41 has a first end of the spring plate secured to the slide plate, with a second end of the spring plate mounting a support mount. The support mount includes a recess 43 to receive a football simulation member 44 permitting projection of the football simulation member 44 in a manner to permit expression of enthusiasm among individuals employing the above noted organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A football display board, comprising, a rigid display board having a top surface, with the top surface including an opaque simulated football playing field, the playing field having a plurality of parallel line webs directed therethrough, with a first end of the display board adjacent the playing field including a first end zone, and a second end of the football playing field adjacent the playing field including a second end zone, with the first end zone including a first goal post, the second end zone including a second goal post, and a first end of the playing field having a first goal line, the second end of the playing field having a second goal line, a plurality of rows of first helmet posts orthogonally directed into the playing field adjacent the first goal line, and a plurality of rows of second helmet posts directed orthogonally and fixedly into the playing field adjacent the second goal line, with first helmet members mounted on the first goal post and second helmet members mounted on the second goal post, where the first helmet members and the second helmet members are movably mounted relative to respective first helmet post and second helmet post, and each of the first helmet posts includes an adjacent first record post, with each said record post fixedly mounted into the playing field in a parallel relationship to an adjacent one of said first helmet posts, and a plurality of second record posts fixedly mounted into the playing field, with each of said second record posts positioned in a parallel adjacency relative to one of said second helmet posts, and a plurality of receiving tubes, with each receiving tube arranged for mounting upon one of said record posts, with each receiving tube having an erasable flange projecting therefrom, with each erasable flange arranged for having imparted thereon a message.

2. A display board as set forth in claim 1 wherein each of the first record posts and second record posts are formed of a ferromagnetic material, and each of said receiving tubes are formed of a ferrous metallic material for magnetic adherence to one of said first record posts and said second record posts.

3. A display board as set forth in claim 2 with the display board including an illumination housing fixedly secured thereto, with an illumination bulb mounted within the illumination housing, and a switch member arranged for selective illumination of the illumination housing, and a lens plate mounted coextensively relative to and in adjacency to the playing field, with each of the line webs formed as a transparent opening, wherein each of the line webs are arranged for receiving illumination through the lens plate upon illumination of the illumination bulb.

4. A display board as set forth in claim 3 wherein the lens plate includes a concave end wall in facing relationship relative to the illumination bulb.

5. A display board as set forth in claim 4 wherein the display board further includes a slide plate reciprocatably mounted relative to the display board, the display board including a socket to slidably receive the slide plate, and a spring plate having a spring plate first end secured to the slide plate and a spring plate second end, the spring plate second end including a support mount, the support mount having a recess, and a football simulation member arranged for positioning upon the recess permitting projection of the football simulation member to the first goal post.

* * * * *